US010106300B2

(12) United States Patent
Brannon et al.

(10) Patent No.: US 10,106,300 B2
(45) **Date of Patent: *Oct. 23, 2018**

(54) POUR LIP CLOSURE WITH DRAIN BACK

(71) Applicant: WestRock Slatersville, LLC, Norcross, GA (US)

(72) Inventors: Patrick J. Brannon, Warwick, RI (US); Clifford W. Skillin, Blackstone, MA (US); Gordana K. Giguere, North Smithfield, RI (US)

(73) Assignee: SILGAN DISPENSING SYSTEMS SLATERSVILLE LLC, Slatersville, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/887,957

(22) Filed: Oct. 20, 2015

(65) Prior Publication Data

US 2016/0046419 A1 Feb. 18, 2016

Related U.S. Application Data

(63) Continuation of application No. 13/786,665, filed on Mar. 6, 2013, now Pat. No. 9,187,219.

(51) Int. Cl.

| | |
|---|---|
| ***B65D 47/40*** | (2006.01) |
| ***B65D 47/08*** | (2006.01) |
| ***B65D 23/06*** | (2006.01) |

(52) U.S. Cl.

CPC ..... *B65D 47/0828* (2013.01); *B65D 23/06* (2013.01); *B65D 47/0838* (2013.01); *B65D 47/40* (2013.01)

(58) Field of Classification Search

CPC .. B65D 47/0828; B65D 47/40; B65D 47/122; B65D 47/06; B65D 47/0838; B65D 23/06; B65D 47/0804

USPC ..... 222/541, 547, 556, 108, 109, 110, 111, 222/562, 566–574; 215/224, 309; 220/283, 294, 288

See application file for complete search history.

(56) References Cited

U.S. PATENT DOCUMENTS

| | | | | |
|---|---|---|---|---|
| 1,749,253 A | | 3/1930 | Levy | |
| 2,025,406 A | | 12/1935 | Whelan | |
| 2,039,345 A | * | 5/1936 | Ravenscroft ..... | B65D 23/06 215/44 |

(Continued)

FOREIGN PATENT DOCUMENTS

JP 2000025821 A 1/2000

*Primary Examiner* — Charles P Cheyney

(74) *Attorney, Agent, or Firm* — Barlow, Josephs & Holmes, Ltd.

(57) ABSTRACT

A closure with a drain back for a container of liquids is disclosed. The closure includes a closure body having an upper deck. A skirt depends from the upper deck and is configured to secure to a neck of a container. An inner annular wall depends from the upper deck within the skirt. The inner wall has a downwardly sloped bottom wall with an edge forming an opening therethrough, forming a drain back for liquid into the container. A tubular spout extends from the bottom wall. The spout has a dispensing orifice. The spout and dispensing orifice configured for fluid communication with the container to dispense liquids therefrom. The closure may further include a sealing cap connected to the closure body via a living hinge.

10 Claims, 5 Drawing Sheets

(56) References Cited

U.S. PATENT DOCUMENTS 2,601,040 A * 6/1952 Livingstone ..... B65D 47/06 215/12.1
2,741,902 A * 4/1956 Thompson ..... B65D 23/06 222/109
2,763,403 A * 9/1956 Livingstone ..... B65D 47/122 222/111
2,793,790 A * 5/1957 Kahler ..... B65D 23/06 222/109
2,820,576 A * 1/1958 Livingstone ..... B65D 47/18 222/110
3,168,221 A 2/1965 Parker
3,208,650 A 9/1965 Ham
3,307,752 A 3/1967 Anderson
3,434,637 A * 3/1969 Henri ..... B65D 47/127 222/570
4,047,648 A * 9/1977 Croyle ..... B65D 47/0895 220/375
4,298,145 A 11/1981 Iida
4,433,800 A * 2/1984 Owens ..... B65D 47/043 222/111
4,550,862 A * 11/1985 Barker ..... B65D 41/26 222/109
4,664,295 A * 5/1987 Iida ..... B29C 45/44 220/270
4,741,459 A * 5/1988 Silvenis ..... B65D 41/26 141/381
4,890,770 A * 1/1990 Haga ..... B65D 47/40 222/109
4,917,268 A 4/1990 Campbell et al.
5,141,138 A 8/1992 Odet et al.
5,251,788 A 10/1993 Moore
5,431,306 A * 7/1995 Reid ..... B65D 47/06 222/109
5,462,202 A 10/1995 Haffner et al.
5,566,862 A * 10/1996 Haffner ..... B65D 47/06 222/109
5,850,953 A 12/1998 Dallas, Jr.
5,855,299 A 1/1999 Arnold et al.
5,875,942 A 3/1999 Ohmi et al.
6,109,487 A 8/2000 Hashimoto
6,352,179 B1 * 3/2002 Andersen ..... A47G 19/145 222/108
6,367,670 B1 4/2002 Warner et al.
6,464,106 B1 10/2002 Giblin et al.
6,474,514 B1 11/2002 Guillemin et al.
6,659,310 B1 12/2003 Wolpert
6,923,341 B2 8/2005 Smith
7,097,076 B1 * 8/2006 Giblin ..... B65D 47/122 222/109
7,390,453 B2 * 6/2008 Brecheisen ..... B29C 49/04 264/515
7,686,188 B2 3/2010 Stebick et al.
7,870,980 B2 * 1/2011 Wilson ..... B65D 47/0809 215/235
8,474,657 B2 * 7/2013 Szekely ..... B65D 47/125 215/329
8,511,492 B2 * 8/2013 Webster ..... B65D 47/06 215/216
2005/0145655 A1 7/2005 Giblin et al.
2006/0267254 A1 11/2006 Brecheisen et al.
2007/0095864 A1 5/2007 Vangeel et al.
2011/0284541 A1 11/2011 Webster et al.
2012/0043295 A1 2/2012 Webster et al.
2013/0075414 A1 3/2013 Van Geel et al.

* cited by examiner

POUR LIP CLOSURE WITH DRAIN BACK

CROSS-REFERENCE TO RELATED APPLICATIONS

This application is a continuation of pending U.S. application Ser. No. 13/786,665, filed 6 Mar. 2013.

BACKGROUND OF THE INVENTION

1. Field of the Invention

The present patent document relates generally to dispensing closures for bottles containing liquids and more particularly to a closure having a spout with a pour lip and a drain back to minimize spillage.

2. Related Art

Containers that hold liquids to be dispensed on demand can have the disadvantage of creating messes when the liquid contained therein drips down the side of the container after being dispensed. Consumer products, like vegetable oil and the like, can be especially messy. Consumers must frequently wipe down the container after use to prevent the liquid from making a mess. Therefore, there is a need in the art for a closure that prevents drips from running down the side of the container.

SUMMARY OF THE INVENTION

The present invention solves the problems of the prior art by providing a closure with a drain back. The closure includes a closure body having an upper deck. A skirt depends from the upper deck and is configured to secure to a neck of a container. An inner annular wall depends from the upper deck within the skirt. The inner wall has a downwardly sloped bottom wall with an edge forming an opening therethrough, forming a drain back for liquid into the container. A tubular spout extends from the bottom wall. The spout has a dispensing orifice. The spout and dispensing orifice configured for fluid communication with the container to dispense liquids therefrom. The closure may further include a sealing cap connected to the closure body via a living hinge.

The spout may further have a pour lip extending from a leading edge of the spout, configured to draw drips against the spout as the container is turned upright, thereby funneling drips back down into the container.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
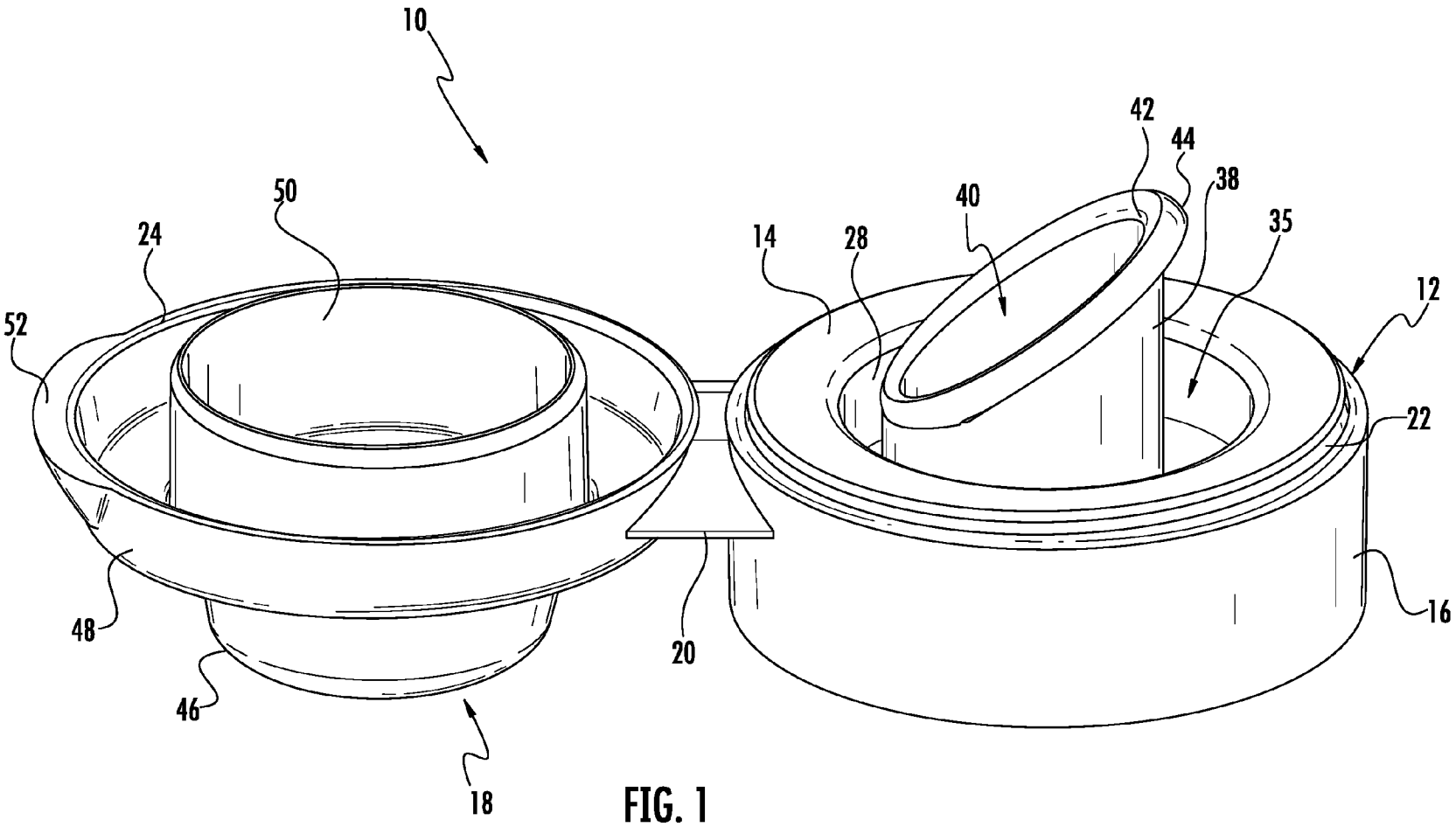
FIG. 1 is a top perspective view of the closure with the cap open.
Figure 2:
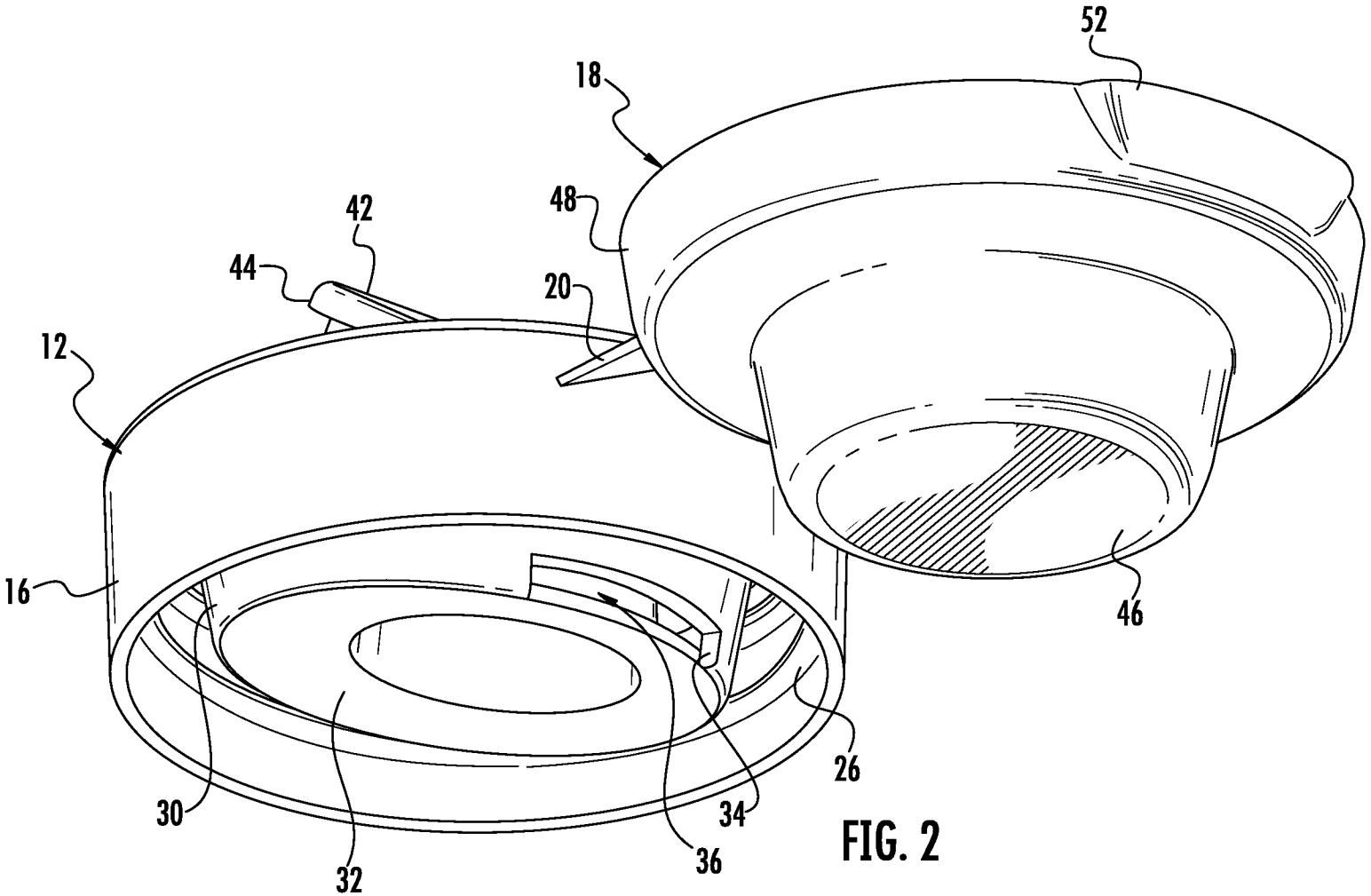
FIG. 2 is a bottom perspective view of the closure.
Figure 3:
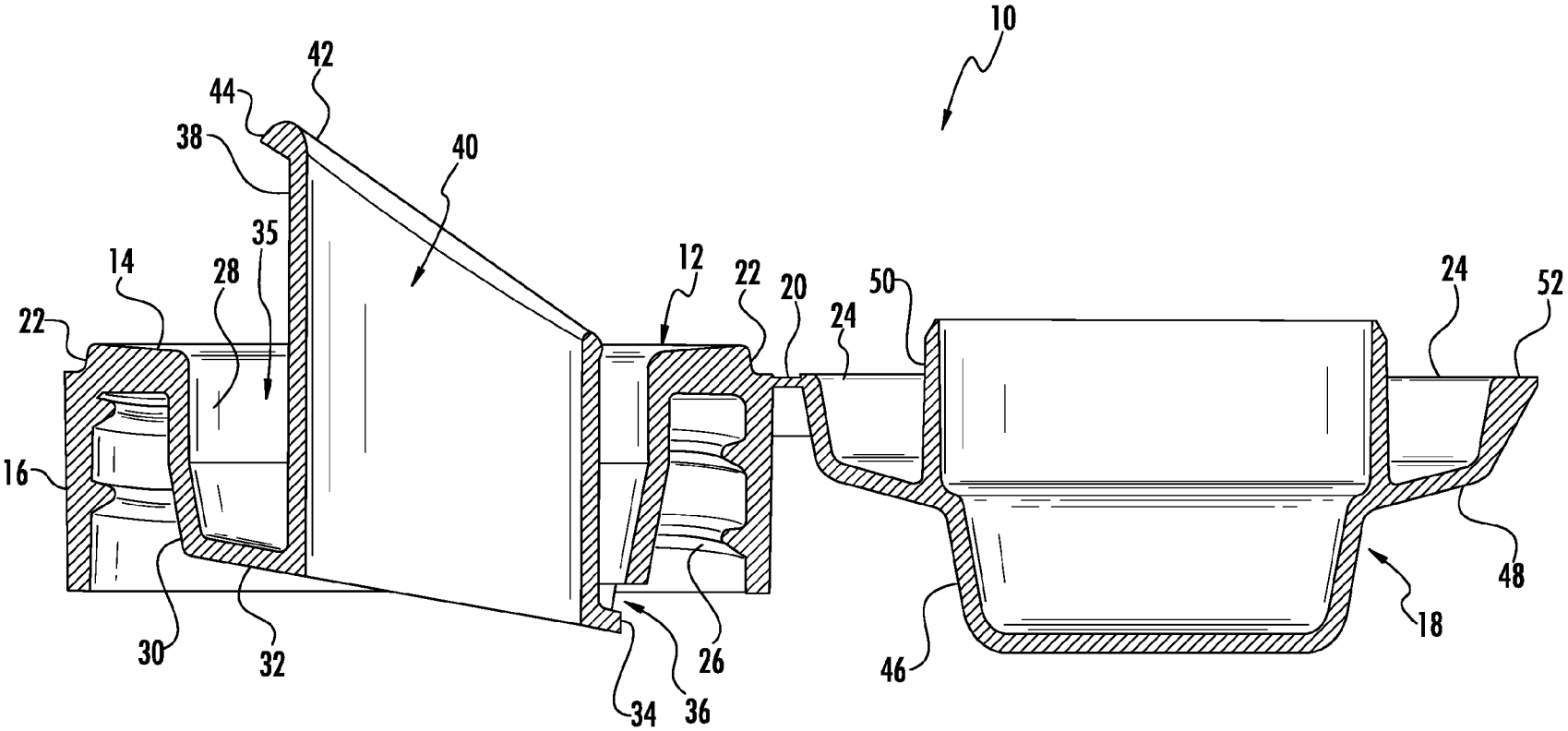
FIG. 3 is a cross-section view through line 3-3 of FIG. 1.
Figure 4:
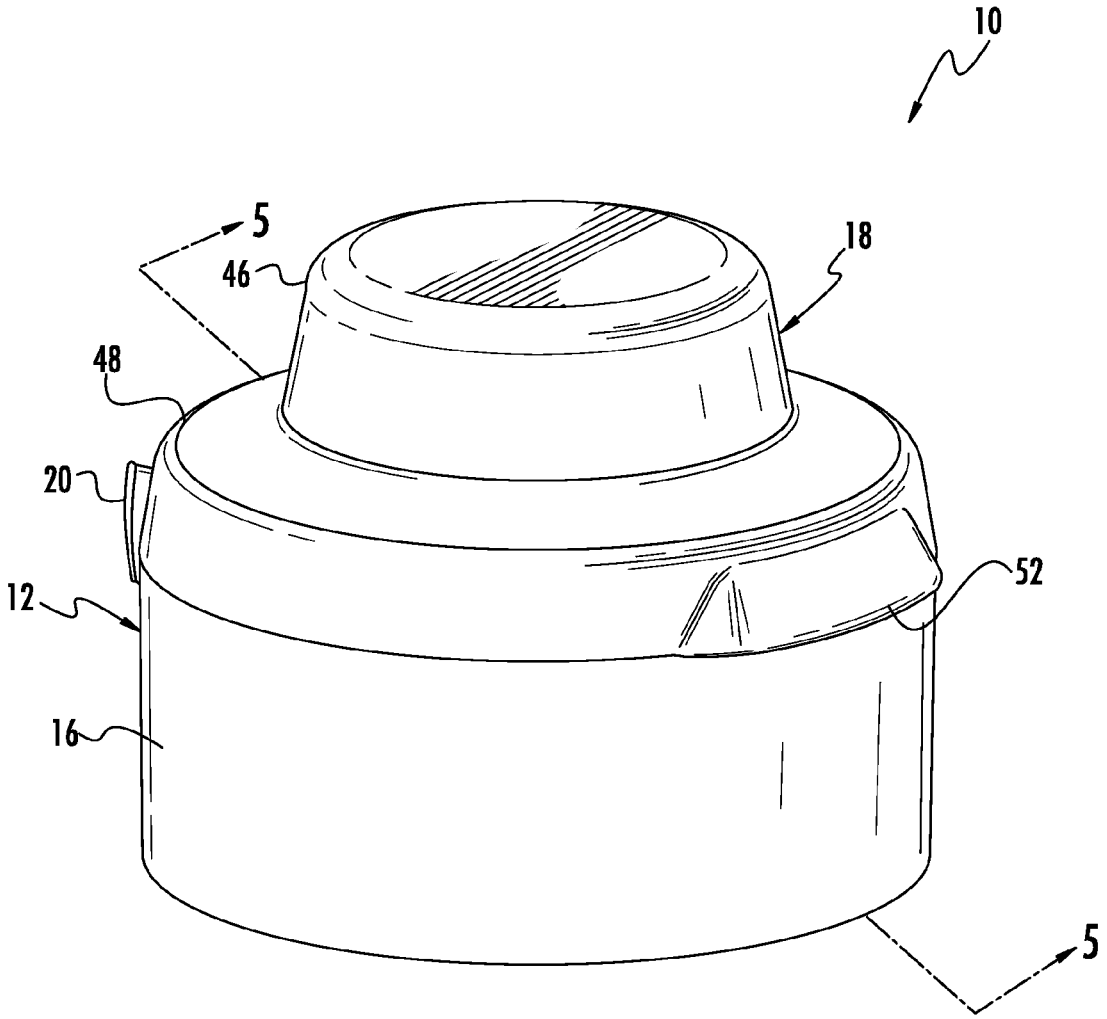
FIG. 4 is a top perspective view of the closure with the cap closed.
Figure 5:
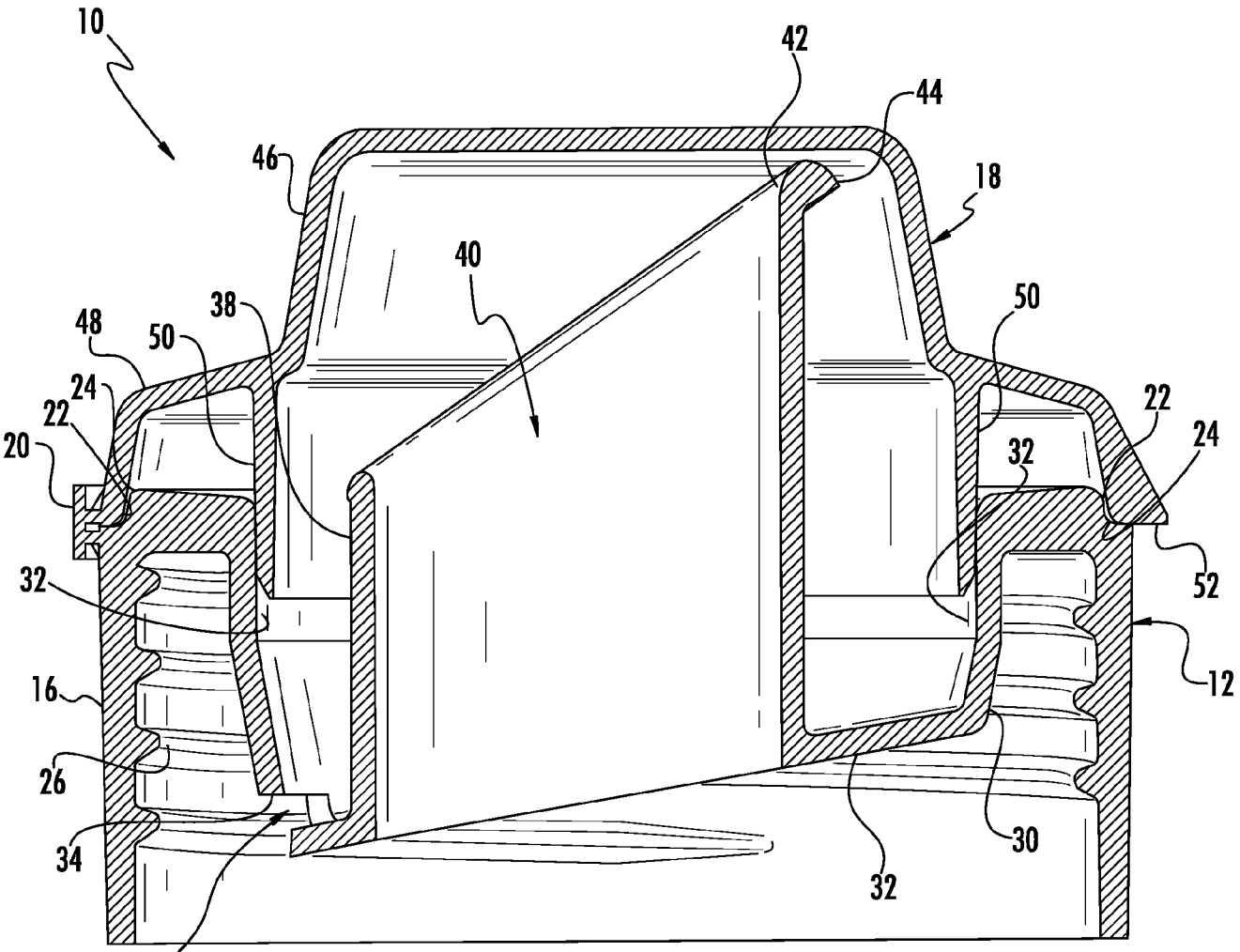
FIG. 5 is a cross-section view through line 5-5 of FIG. 4.

Referring now to FIG. 1-5, the closure is shown generally at 10. The closure includes a closure body 12 having an upper deck 14 with a depending skirt 16. A cap 18 is connected to the closure body 12 via a living hinge 20, which is configured to close the closure 10 when not in use (best seen closed in FIG. 4). A recessed annular wall 22 is formed on the upper deck 14 to receive an outer peripheral edge 24 of the cap 18. The skirt 16 is configured to attach to a neck of a container (not shown), for instance, by threads 26 (best seen in FIGS. 3 and 5).

An inner annular wall 28 depends from the upper deck 14, inwards of the skirt 16. The inner wall 28 may be angled or tapered inwardly, becoming narrower towards a bottom end 30. A bottom wall 32 is connected to the inner annular wall 28, forming a cup-shaped area 35 inside the closure body 12. The bottom wall 32 is pitched or sloped downwardly towards one side. An edge 34 is formed on the inner annular wall 28 and/or bottom wall 32, defining an opening 36 therethrough, forming the drain back from the cup-shaped area 35. Fluids collecting in the cup-shaped area 35 will drain through the opening 36 and back into the container.

Extending from the bottom wall 32 is a cylindrical or tubular spout 38, having a dispensing orifice 40. The dispensing orifice 40 and spout 38 are in fluid communication with the container when the closure 10 is mounted thereto. The dispensing orifice 40 of the spout 38 is preferably angled with a leading edge 42 extending in the direction intended for pouring liquids. A pour lip 44 extends from the leading edge 42 of the spout. The pour lip 44, via capillary action, draws drips against the spout 38 when the container is turned upright after pouring, funneling the drips back down into the cup-shaped area 35, to the bottom wall 32, and, eventually, to the opening 36, where the liquid drains back into the container.

The cap 18 is connected to the closure body 12 via a living hinge 20. The cap 18 may be moved between an open position, allowing dispensing, and a closed, position, sealing closure 10 and the container. The cap 18 includes a top portion 46, which covers the spout 38 when closed, and a peripheral skirt 48 depending therefrom. The peripheral skirt 48 has an outer peripheral edge 24 that contacts the recessed annular wall 22 on the closure body 12 when the cap 18 is closed, thereby presenting a uniform and aesthetically pleasing appearance.

An annular sealing wall 50 depends from an inner surface of the cap 18. The annular sealing wall 50 is configured to contact the inner wall 28 of the closure body 12 in sealing engagement, preventing liquid from exiting the container if the container is inadvertently tipped over. The cap 18 may include a thumb catch 52 depending from the outer peripheral skirt 48 to assist in opening the cap 18.

Therefore, it can be seen that the present invention provides a unique solution to the problem of providing a closure that prevent spillage. The consumer dispenses product from the container and through the closure as normal. However, when the user uprights the container, drips on the spout that would normally run off the closure body and down the sidewall of the container, are instead funneled back down into the container.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A closure, comprising:

a closure body having an upper deck;

a skirt depending from the upper deck configured and arranged to secure to a neck of a container;

an inner annular wall depending from the upper deck within the skirt;

a downwardly sloped bottom wall depending from a lower peripheral edge of said inner annular wall;

an opening in said inner annular wall at said lower peripheral edge, said opening providing a drain back path for liquid to re-enter the container;

a tubular spout extending from the bottom wall, the spout having an unbroken cylindrical wall with a dispensing orifice, the spout and dispensing orifice configured for fluid communication with the container to dispense liquids therefrom; and a pour lip extending from a leading edge of the spout radially outward from an inner wall to an outer wall in the direction intended for pouring, the pour lip having a rounded convex surface extending upwardly from the inner wall, rounding over radially outwardly and then extending downwardly and outwardly to a terminal edge located radially outward of the outer wall, said pour lip further having a flat straight surface extending at an angle downwardly and radially inwardly from said terminal edge and merging with said outer wall, whereby when the container is turned upright, the rounded convex surface and the flat straight surface cooperate to cause drips to draw against the outside surface of the tubular spout via capillary action, funneling said drips to the drain back and into the container.

2. The closure of claim 1, wherein the dispensing orifice is angled on the spout and has an elliptical shape.

3. The closure of claim 2, further comprising a cap configured and arranged for sealing engagement with the closure body.

4. The closure of claim 3, wherein the cap is connected to the closure body via a living hinge.

5. The closure of claim 4, further comprising a thumb catch extending from the cap.

6. The closure of claim 3, wherein the cap comprises an annular sealing wall depending therefrom configured to contact the inner wall of the closure body.

7. The closure of claim 4, wherein the cap comprises an annular sealing wall depending therefrom configured to contact the inner wall of the closure body.

8. The closure of claim 5, wherein the cap comprises an annular sealing wall depending therefrom configured to contact the inner wall of the closure body.

9. The closure of claim 8, wherein the closure body includes a recessed annular wall formed between the upper wall and skirt, configured to receive an outer peripheral edge of the cap.

10. The closure of claim 9, wherein the inner wall narrows towards the bottom wall.

* * * * *